US012179057B2

(12) United States Patent
Mugulusi

(10) Patent No.: US 12,179,057 B2
(45) Date of Patent: Dec. 31, 2024

(54) DUMBBELLS

(71) Applicant: Moses Mugulusi, New York, FL (US)

(72) Inventor: Moses Mugulusi, New York, FL (US)

( * ) Notice: Subject to any disclaimer, the term of this patent is extended or adjusted under 35 U.S.C. 154(b) by 0 days.

(21) Appl. No.: 17/487,371

(22) Filed: Sep. 28, 2021

(65) Prior Publication Data

US 2022/0105383 A1 Apr. 7, 2022

Related U.S. Application Data

(60) Provisional application No. 63/086,985, filed on Oct. 2, 2020.

(51) Int. Cl.
*A63B 21/06* (2006.01)
*A63B 21/072* (2006.01)
*A63B 21/075* (2006.01)

(52) U.S. Cl.
CPC ..... *A63B 21/0601* (2013.01); *A63B 21/0728* (2013.01); *A63B 21/075* (2013.01)

(58) Field of Classification Search
CPC ..... A63B 21/0601; A63B 21/0605; A63B 21/06–0607; A63B 21/072–075; A63B 21/00058–00065; A63B 2209/08; A63B 2244/09
See application file for complete search history.

(56) References Cited

U.S. PATENT DOCUMENTS 5,769,762 A * 6/1998 Towley, III ..... A63B 21/0605 482/93
7,011,611 B1 * 3/2006 Ripley ..... A63B 21/0728 482/107
7,458,920 B2 * 12/2008 Hallar ..... A63B 21/072 482/910
8,622,878 B2 * 1/2014 Abelbeck ..... A63B 21/4035 482/93
9,937,373 B2 * 4/2018 Gvoich ..... A63B 21/4035
10,188,892 B1 * 1/2019 Gvoich ..... A63B 21/0605

* cited by examiner

*Primary Examiner* — Loan B Jimenez
*Assistant Examiner* — Kathleen M Fisk
(74) *Attorney, Agent, or Firm* — Gearhart Law, LLC

(57) ABSTRACT

An exercise apparatus is described. The apparatus includes a body having a first end disposed opposite a second end. The body also includes a first side disposed opposite a second side and a third side disposed opposite a fourth side. The first side includes a first hand grip and the second side includes a second hand grip. The body includes one or more receiving portions configured to receive one or more weights therein. The body has a hollow interior. In some examples, the hollow interior is divided into two hollow interior portions.

11 Claims, 21 Drawing Sheets

DUMBBELLS

CLAIM OF PRIORITY

This application is a non-provisional application, which claims priority to U.S. provisional application No. 63/086,985 filed on Oct. 2, 2020, the disclosures of which is incorporated in its entirety by reference herein.

FIELD OF THE EMBODIMENTS

The field of the invention and its embodiments relate to handheld dumbbells. In particular, the present invention relates to handheld dumbbells having multiple grip locations.

BACKGROUND OF THE EMBODIMENTS

A handheld dumbbell is a fixed weight that may be used for exercise, therapy, rehab, or any other activity requiring added resistance. Typical dumbbells are designed such that a handle is disposed between weights on opposing sides of the exercise device. Other types of weights, such as a kettle bell, have a weight positioned on one side of a handle. These designs of dumbbells may result in an imbalanced exercise device which may become increasingly problematic as the weights become greater. Such dumbbells requires sufficient wrist strength in addition to the targeted muscle group being worked to balance the weight during the exercise or movement being performed.

As such, traditional dumbbells are cumbersome to use, especially with larger weights because of the resulting elongated shape and unequal weight distribution about the user's hands. These weights also present a risk to the user because of the wrist strength required without providing any wrist support during the exercise or movement being performed. Moreover, these types of traditional exercise devices provide a singular hand/grip location, and as such, the quantity and types of exercises that may be performed with the exercise device are limited. As such, improved handheld dumbbells are needed that provide multiple grip locations, and thus, allow the user to engage in multiple exercises.

Examples of Related Art

U.S. Pat. No. 4,673,179 A describes a device for performing gymnastic exercises or the like. The device includes a geometrically regular body including a plurality of polygonally-shaped flat sides and a plurality of spaced handle means. The handle means are defined by at least two elongated spaced openings in the surface of the body which flank the intersection between two of the flat sides. These openings cooperate with at least the remaining portion of the surface intervening therebetween to define elongated graspable hand-holds at the facial intersections.

U.S. Pat. No. 8,454,485 B1 describes a weighted and stackable exercise device. The deice includes a body defining a hollow cavity opening at a first edge thereof. The body has a side wall having at least one cut-out. An outwardly projecting rim is on the tubular portion of the body. A handle is in the cavity. The rim provides a first grip for a user during use of the exercise device and the handle provides a second grip for the user. By providing two different grips on the same weighted exercise device, a user can safely and efficiently perform a larger variety of exercises in comparison to using conventional exercise devices that include a single type of grip. The user can pass their fingers and hand from an exterior of the device through each cut-out and over the rim to grip the device in another manner and perform more and different exercises.

WO 2017/131996 A1 and U.S. Published Patent Application No. 2018/0296871 A1 describe a selectorized dumbbell. The selectorized dumbbell has a plurality of nested weights that provide a stack of left weight plates and a stack of right weight plates. A handle is dropped between the stacks and a selector is inserted into one of a plurality of vertically spaced positions on the handle to couple a selected number of the weights to the handle. The selector has a continuous periphery enclosing an open interior. A user who is exercising with the dumbbell will be alerted to unintended dislodgement of the selector since a portion of the selector's periphery will contact a portion of the user's grip hand, wrist, or forearm during such dislodgement. This prevents complete dislodgement and prompts the user to restore the selector to a fully installed position. Side walls of the selector may become curved when the selector is installed to provide an additional frictional force resisting dislodgement of the selector.

U.S. Pat. No. 9,604,092 B2 describes an exercise dumbbell. The exercise dumbbell includes a handle member and weights positioned at opposite ends of the handle member. An additional weight forms a box about the handle member and the end weights. At least one weight selector is movably mounted on the handle member to selectively engage the end weights. At least one connector is movably mounted on the box weight to selectively engage the handle member. A circuit includes at least one sensor that generates a signal that represents how much force is required to lift the handle member and any weights secured thereto, and a display that displays the force. At least one latch prevents movement of the selector and/or the connector when the handle member is removed from a support base for the weights and the handle member.

CN 105854220 A describes triangular kettlebells. The invention discloses a triangular kettlebell which comprises three identically equal handles and a hollow cylinder. Carrying holes in the shapes of rounded rectangles are formed in the handles, and the hollow cylinder is filled with fillers.

U.S. Pat. No. 9,375,602 B2 describes an exercise dumbbell. The exercise dumbbell includes a handle member and weights positioned at opposite ends of the handle member. An additional weight forms a box about the handle member and the end weights. At least one weight selector is movably mounted on the handle member to selectively engage the end weights. At least one connector is movably mounted on the box weight to selectively engage the handle member. A circuit includes at least one sensor that generates a signal that represents how much force is required to lift the handle member and any weights secured thereto, and a display that displays the force. At least one latch prevents movement of the selector and/or the connector when the handle member is removed from a support base for the weights and the handle member.

U.S. Published Patent Application No. 2015/0360074 A1 describes a balanced dumbbell. The balanced dumbbell includes a first weight having a hollow cylindrical shape extending in a first axial direction and a second weight having a hollow cylindrical shape extending in a second axial direction perpendicular to the first axial direction. A wrist support is disposed within a cutout on an upper end of the first weight and the second weight and defines an opening of the balanced dumbbell. A handle extends between inner surfaces of the first weight and is configured to be accessed by a user through the opening.

U.S. Published Patent Application No. 2015/0352398 A1 describes an exercising device that includes two hollow shells combined with each other, two grips mounted on the hollow shells respectively, and two weight modules mounted in the hollow shells respectively. Thus, the hollow shells can be combined together and separated from each other to function as a weighting ball, a push-up aid device and dumbbells, so that the exercising device has multiple functions to perform diverse exercising and bodybuilding motions.

U.S. Pat. No. 9,011,299 B2 describes a weight lifting system includes a handle unit having a handle bar, two head units attached to two end sections of the handle bar in a manner that allows the two head units to rotate about a longitudinal axis of the handle bar, two screw rods disposed through holes in the two head units into hollow sections in the handle bar, wherein the two screw rods have threads of opposite directions, two thread-engaging mechanisms fixedly disposed at the two end sections of the handle bar to fit snugly on the threads of the two screw rods, and a lock mechanism disposed in a head unit for controlling rotation of the handle bar; and a plurality pairs of weight discs, wherein each of the weight discs has a center hole configured to accommodate one of the two screw rods.

Some handheld weights exist in the art. However, their means of operation are substantially different from the present disclosure, as the other inventions fail to solve all the problems taught by the present disclosure.

SUMMARY OF THE EMBODIMENTS

The present invention and its embodiments relate to handheld dumbbells. In particular, the present invention relates to handheld dumbbells having multiple grip locations.

A first embodiment of the present invention describes an exercise apparatus. The first embodiment of the exercise apparatus includes a body. In some examples, the first embodiment of the exercise apparatus is a handheld dumbbell. The body of the exercise apparatus includes a first end disposed opposite a second end. Moreover, the body of the exercise apparatus includes a first side disposed opposite a second side and a third side disposed opposite a fourth side. The body of the exercise apparatus also includes a hollow interior. Moreover, the body of the exercise apparatus includes a first opening proximate the first end of the body and a second opening proximate the second end of the body.

The first side of the body of the exercise apparatus comprises a first hand grip and the second side comprises a second hand grip. It should be appreciated that a user may grasp the first hand grip or the second hand grip during a time period when engaging with the exercise apparatus. In an example, the first hand grip comprises a first shape and the second hand grip comprises a second shape. As depicted, the first shape differs from the second shape. More specifically, the first shape of the first hand grip comprises a portion disposed between two parallel openings spanning a length of the first side from the first opening to the second opening. The two parallel openings are perpendicular to the first opening and are perpendicular to the second opening. As depicted, the second shape of the second hand grip comprises a portion disposed between two horizontal openings spanning a width of the second side. In this example, the two horizontal openings are parallel to the first opening and are parallel to the second opening.

The third side of the body of the exercise apparatus comprises a first receiving portion configured to receive a first weight therein. Moreover, the fourth side of the body of the exercise apparatus comprises a second receiving portion configured to receive a second weight therein. It should be appreciated that the weight may be any weight denomination (e.g., 2 pounds, 5 pounds, 10 pounds, 15 pounds, etc.).

As depicted, the first weight and the second weight share a shape. In examples, the shape of each of the first weight and the second weight may be a rectangular shape or a substantially rectangular shape, among other examples not explicitly listed herein. As such, a shape of the exercise apparatus may be a cubic shape, a substantially cubic shape, a rectangular shape, or a substantially rectangular shape, among other examples not explicitly listed herein.

In examples, the first weight is affixed to the first receiving portion and the second weight is affixed to the second receiving portion via a fixation means. Examples of illustrative fixation means include a magnetic fixation means, a bolt and screw fixation means, a snap fixation means, or an adhesive fixation means, among other examples not explicitly listed herein. It should be appreciated that these fixation means are provided for illustrative purposes only and other fixation means are contemplated by Applicant.

A second embodiment of the present invention describes the exercise apparatus. The second embodiment of the exercise apparatus comprises a body. The body includes a first end disposed opposite a second end. Moreover, the body of the exercise apparatus includes a first side disposed opposite a second side and a third side disposed opposite a fourth side. The first side of the body of the exercise apparatus comprises a first hand grip and the second side of the body of the exercise apparatus comprises a second hand grip. It should be appreciated that a user may grasp both the first hand grip and the second hand grip during a time period when engaging with the exercise apparatus.

In examples, the first hand grip and the second hand grip share a shape. In this example, the shape of each of the first hand grip and the second hand grip comprises an opening proximate the first end of the body. Moreover, the shape of each of the first hand grip and the second hand grip is parallel to the first end of the body.

In additional examples, the first side and the second side share a first length. The third side and the fourth side share a second length. The second length is greater than the first length such that the exercise apparatus is rectangular in shape.

The third side of the body of the exercise apparatus includes a first portion disposed between a first receiving portion configured to receive a first weight therein and a second receiving portion configured to receive a second weight therein. Moreover, the fourth side of the body of the exercise apparatus comprises a second portion disposed between a third receiving portion configured to receive a third weight therein and a fourth receiving portion configured to receive a fourth weight therein.

A third portion is disposed perpendicular to the first portion and perpendicular to the second portion such that the third portion divides an interior of the body into a first hollow interior portion and a second hollow interior portion. The third portion of the body of the exercise apparatus comprises a fifth receiving portion proximate the first hollow interior portion and a sixth receiving portion proximate the second hollow interior portion. The fifth receiving portion is configured to receive a fifth weight therein and sixth receiving portion is configured to receive a sixth weight therein.

It should be appreciated that each of the first weight, the second weight, the third weight, the fourth weight, the fifth weight, and the sixth weight are affixed to the first receiving portion, the second receiving portion, the third receiving portion, the fourth receiving portion, the fifth receiving portion, and the sixth receiving portion, respectively, via the fixation means.

In general, the present invention succeeds in conferring the following benefits and objectives.

The present invention provides an exercise apparatus having multiple hand-grip locations.

The present invention provides handheld dumbbells having multiple hand-grip locations.

DESCRIPTION OF THE PREFERRED EMBODIMENTS

Figure 1:
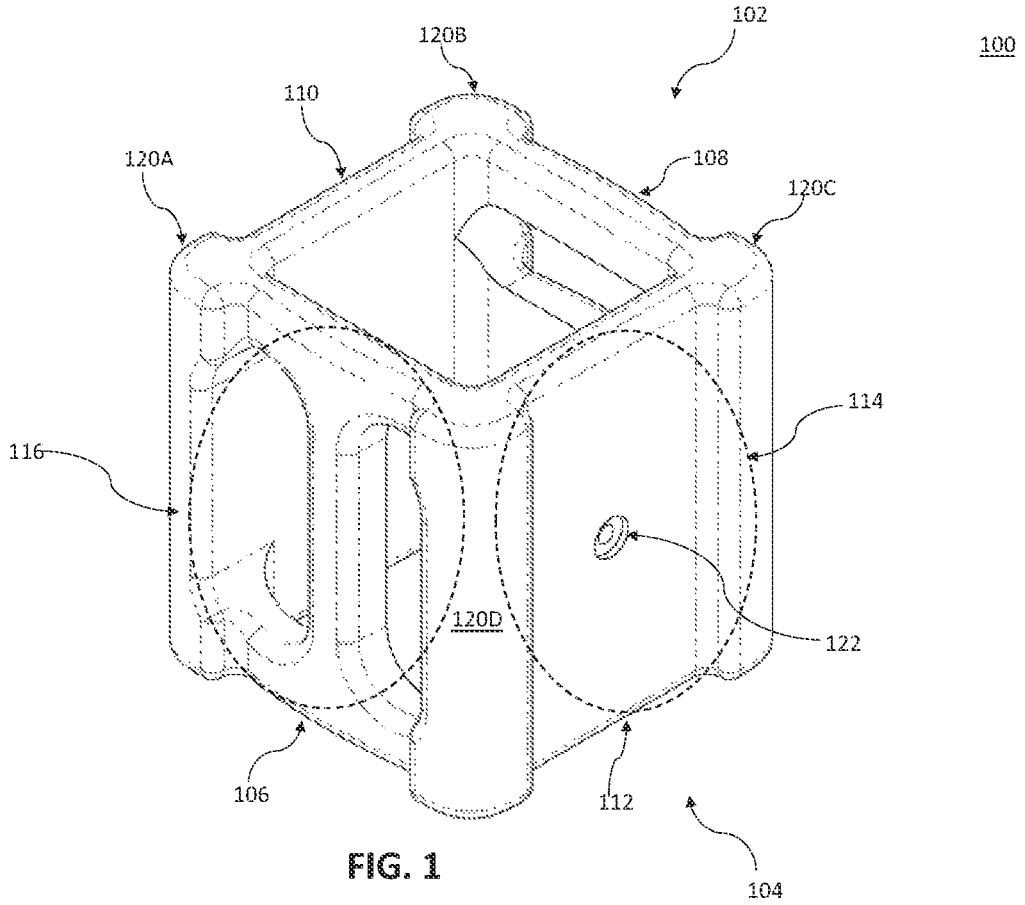
FIG. 1 and FIG. 2 depict perspective view of schematic diagrams of a first hand grip of a first embodiment of an exercise apparatus, according to at least some embodiments disclosed herein.

The preferred embodiments of the present invention will now be described with reference to the drawings. Identical elements in the various figures are identified with the same reference numerals. Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 2:
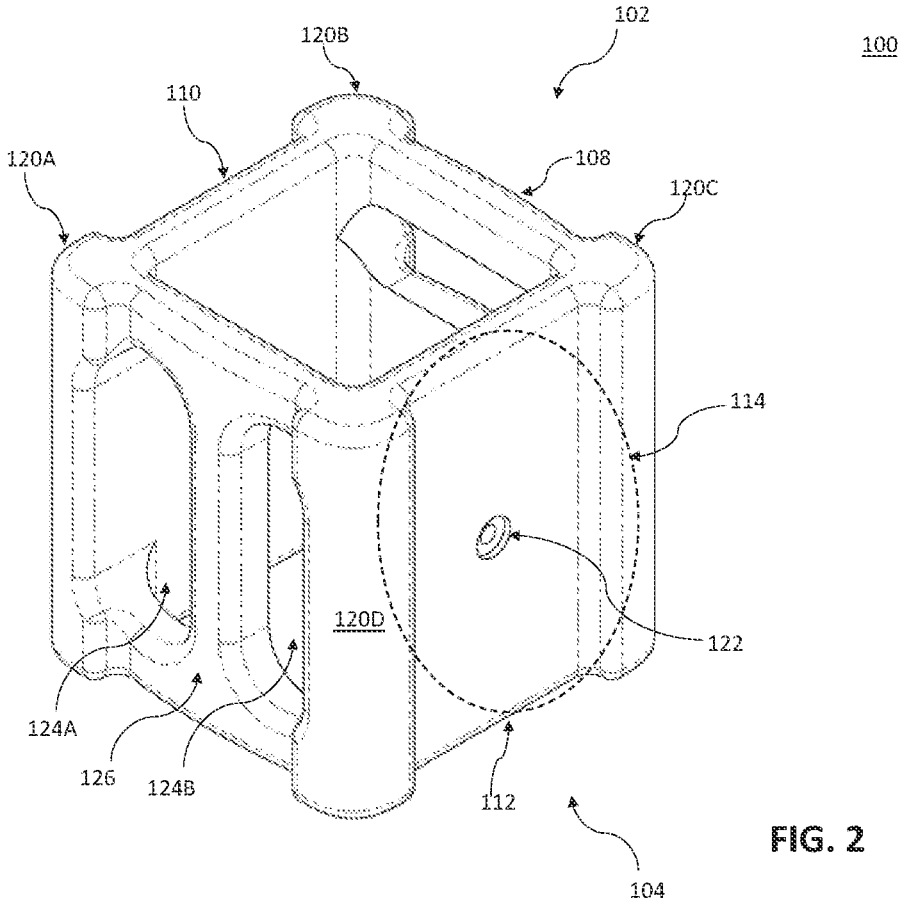
Figure 3:
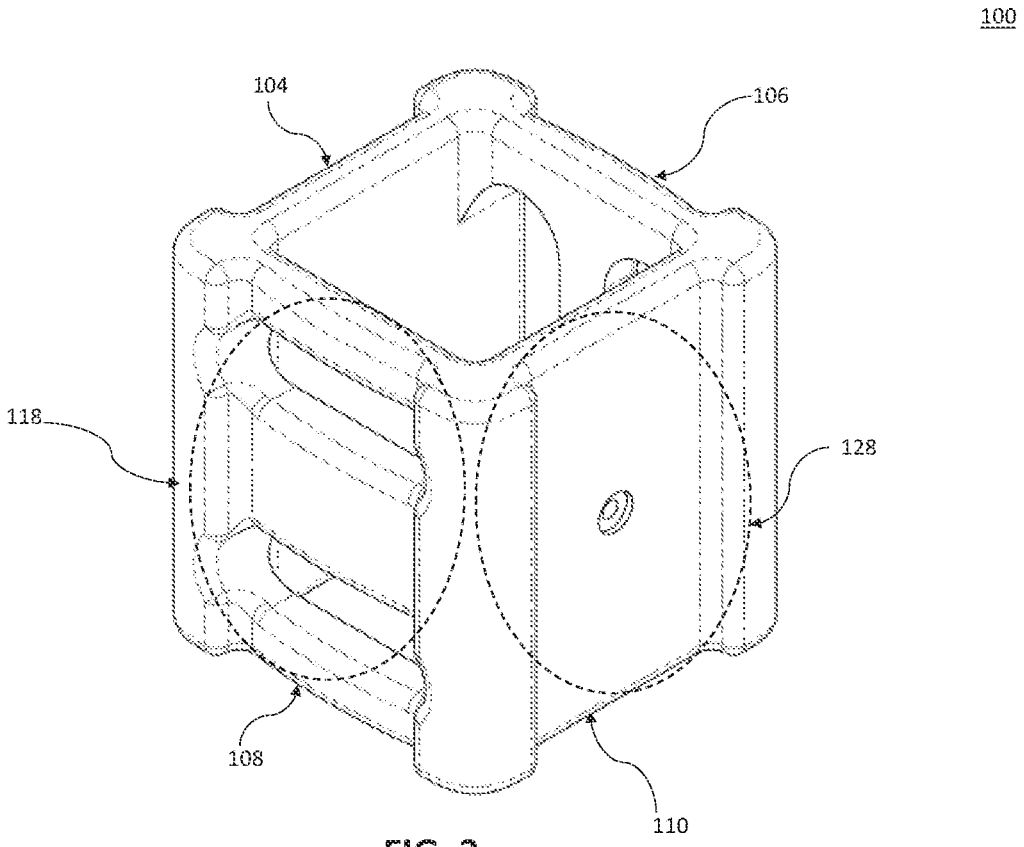
FIG. 3 and FIG. 4 depict perspective view of schematic diagrams of a second hand grip of a first embodiment of an exercise apparatus, according to at least some embodiments disclosed herein.
Figure 4:
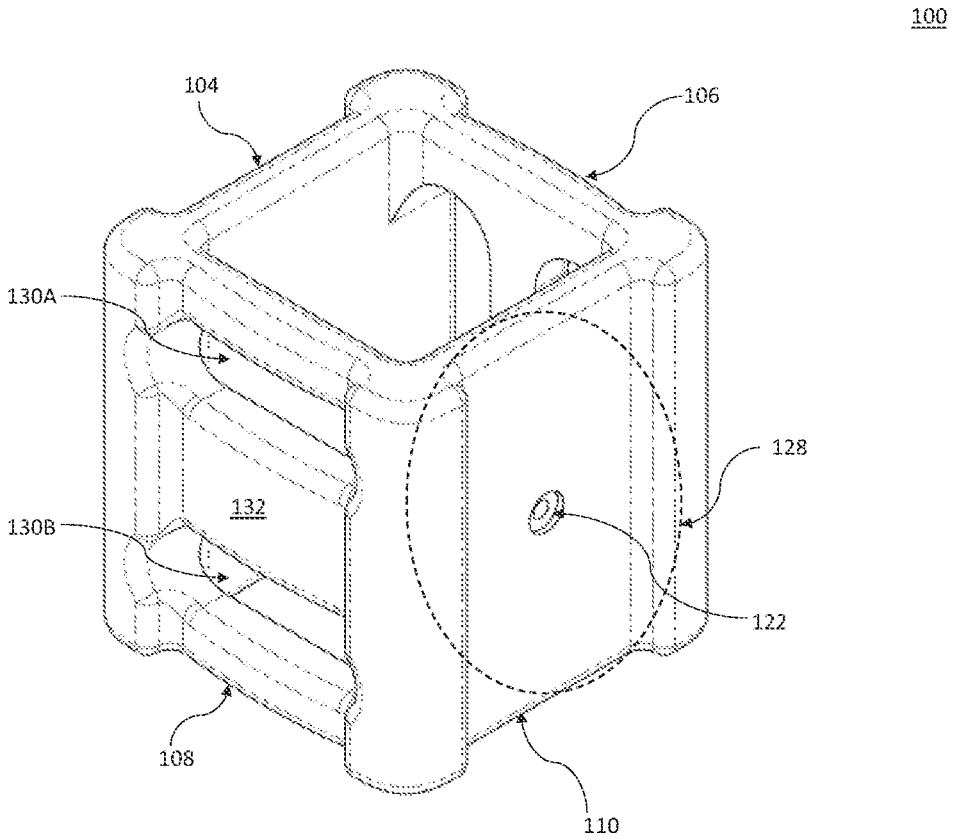
Figure 5:
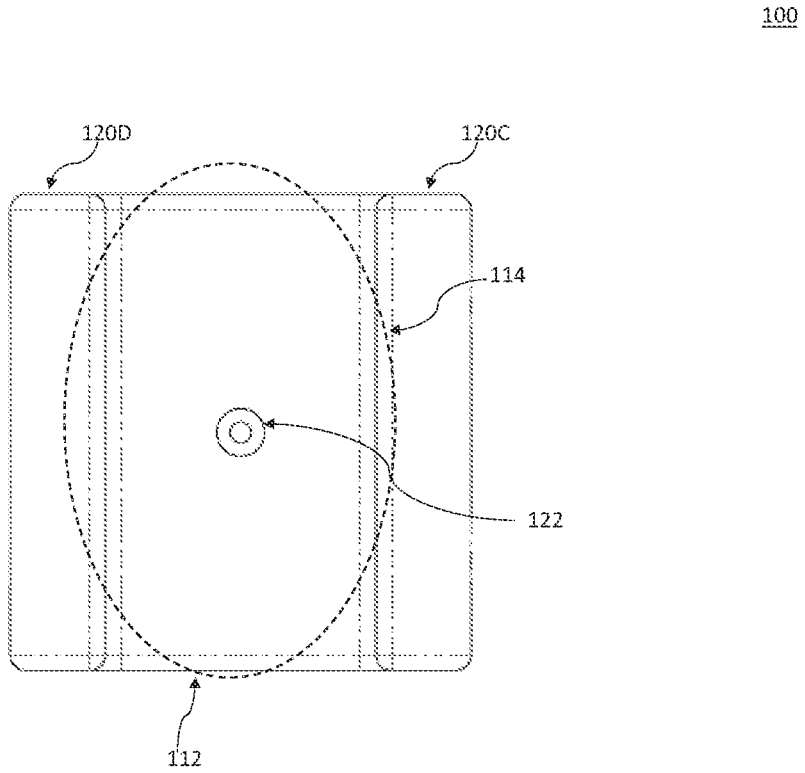
FIG. 5 depicts a side view of a schematic diagram of a receiving portion of a first embodiment of an exercise apparatus, the receiving portion being configured to receive a first weight therein, according to at least some embodiments disclosed herein.
Figure 6:
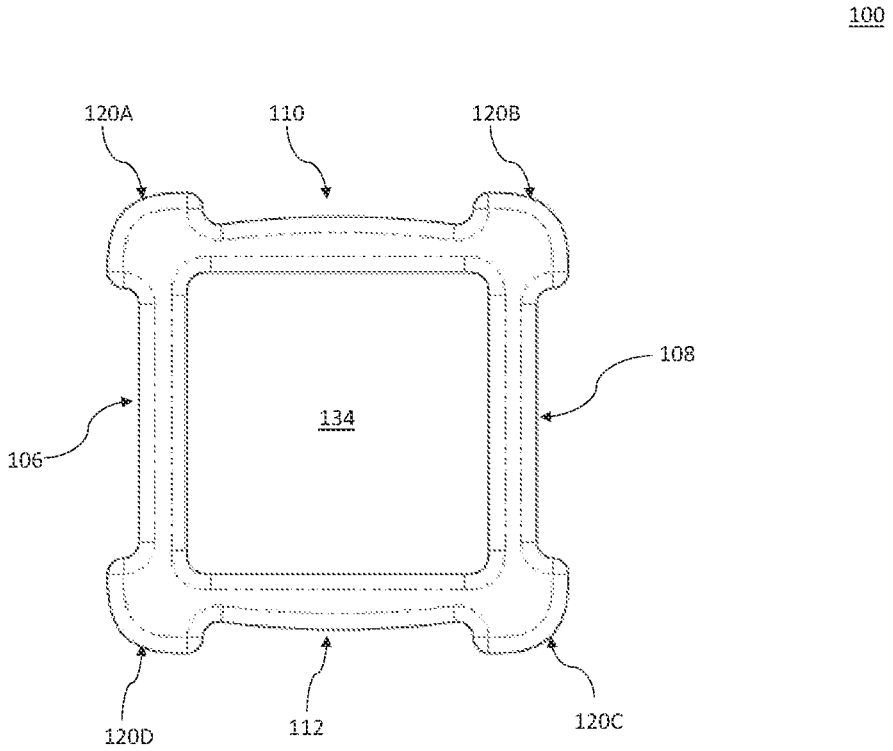
FIG. 6 depicts a top down view of a schematic diagram of a first embodiment of an exercise apparatus, according to at least some embodiments disclosed herein.
Figure 7:
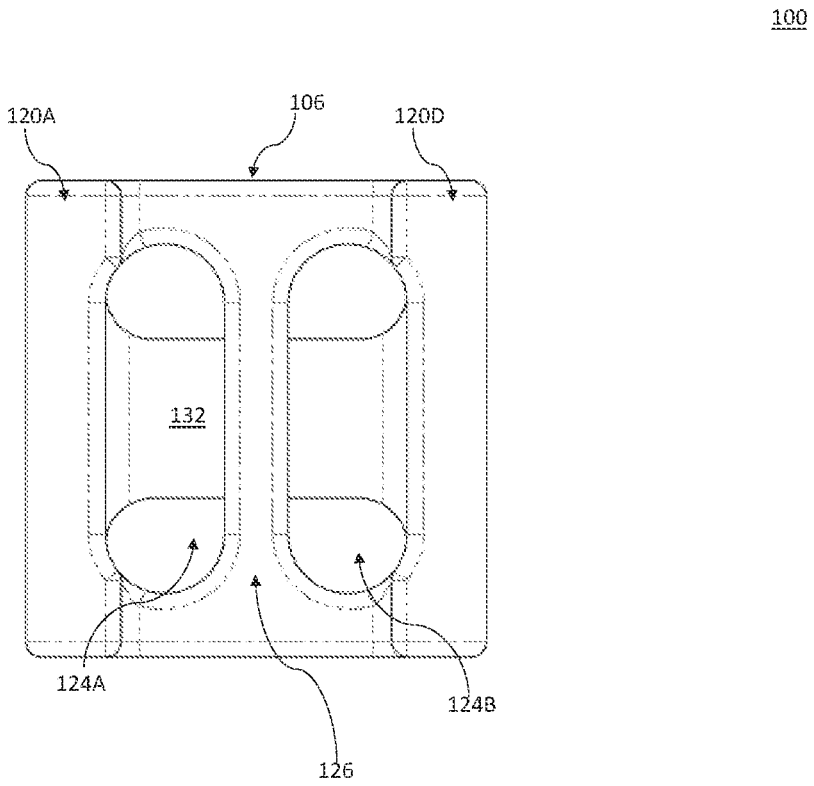
FIG. 7 and FIG. 8 depict side views of schematic diagrams of a first embodiment of an exercise apparatus, according to at least some embodiments disclosed herein.
Figure 8:
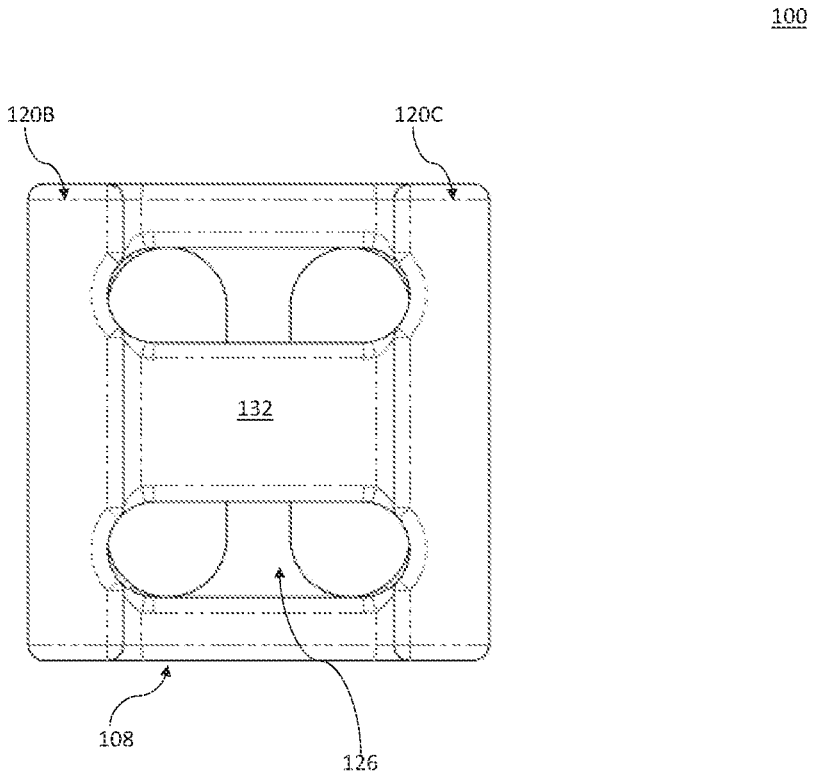
Figure 9:
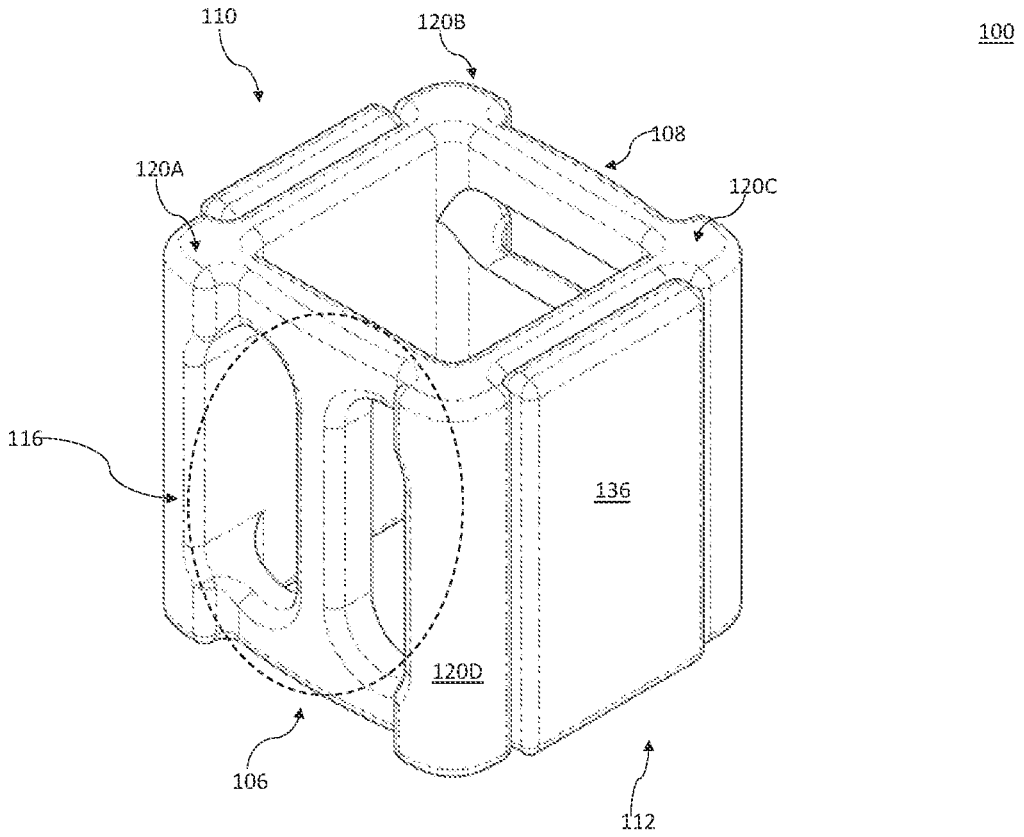
FIG. 9 depicts a perspective view of a schematic diagram of a first hand grip of a first embodiment of an exercise apparatus, the exercise apparatus having a first and a second weight affixed to a first and a second receiving portion, respectively, according to at least some embodiments disclosed herein.
Figure 10:
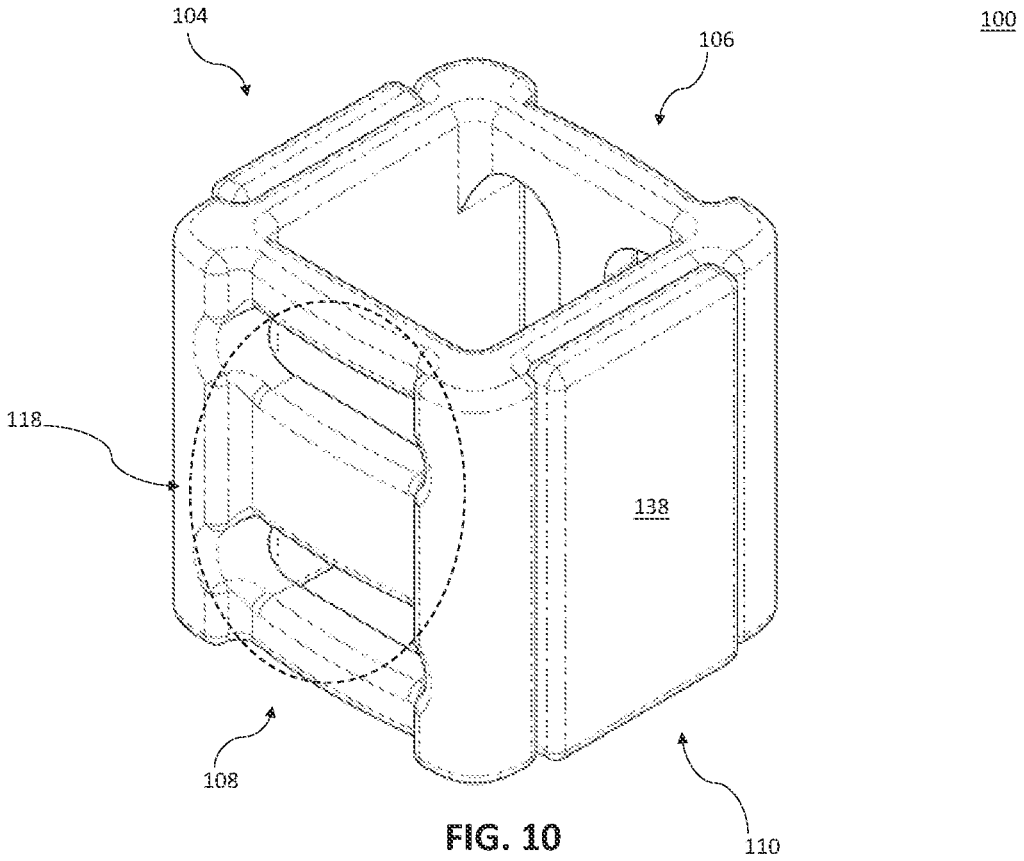
FIG. 10 depicts a perspective view of a schematic diagram of a second hand grip of a first embodiment of an exercise apparatus, the exercise apparatus having a first and a second weight affixed to a first and a second receiving portion, respectively, according to at least some embodiments disclosed herein.
Figure 11:
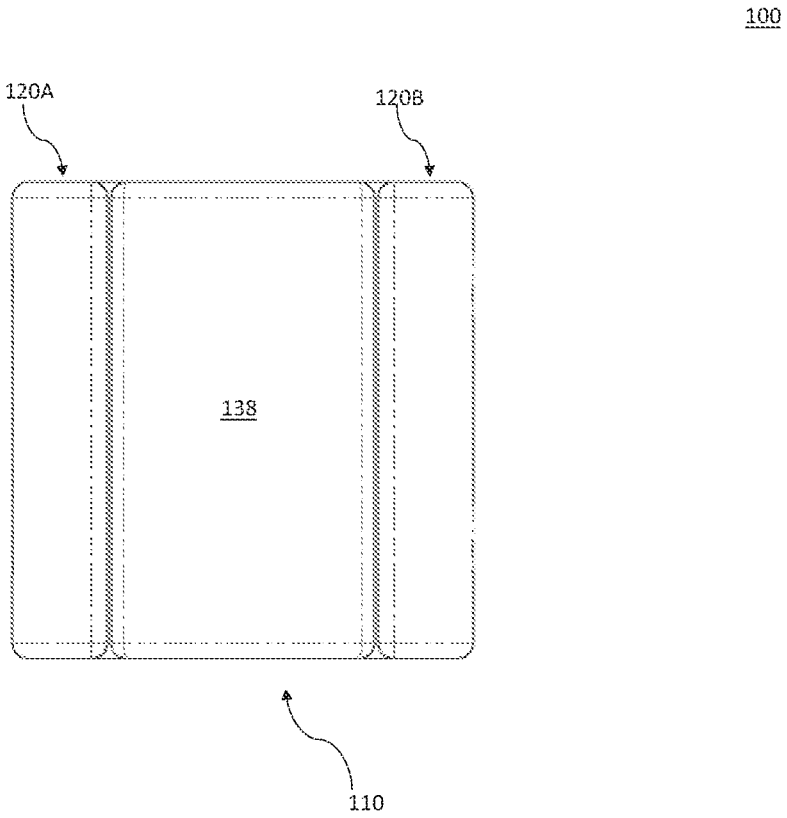
FIG. 11 depicts a side view of a schematic diagram of a weight affixed to a first embodiment of an exercise apparatus, according to at least some embodiments disclosed herein.
Figure 12:
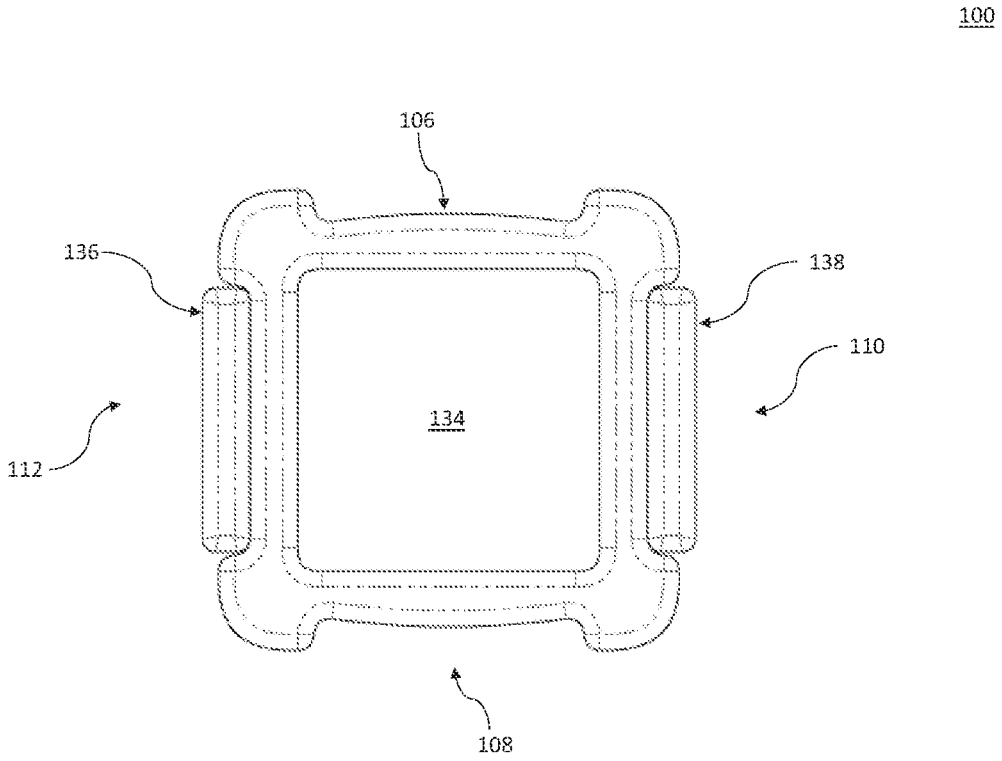
FIG. 12 depicts a top down view of a schematic diagram of a first embodiment of an exercise apparatus, the exercise apparatus having a first and a second weight affixed to a first and a second receiving portion, respectively, according to at least some embodiments disclosed herein.

An exercise apparatus is described and depicted herein. A first embodiment 100 of the exercise apparatus is depicted in FIG. 1-FIG. 12. The first embodiment 100 of the exercise apparatus includes a body. In some examples, the first embodiment 100 of the exercise apparatus comprises a handheld dumbbell. The body of the first embodiment 100 of the exercise apparatus includes a first end 102 disposed opposite a second end 104.

Moreover, the body of the first embodiment 100 of the exercise apparatus includes a first side 106 disposed opposite a second side 108. Further, the body of the first embodiment 100 of the exercise apparatus include a third side 110 disposed opposite a fourth side 112. Columns 120A, 120B, 120C, and 120D separate the first side 106, the second side 108, the third side 110, and the fourth side 112 of the body of the first embodiment 100 of the exercise apparatus. Further, the body of the exercise apparatus also includes a hollow interior. Also, the body of the exercise apparatus includes a first opening proximate the first end of the body and a second opening proximate the second end of the body.

The first side 106 of the body of the first embodiment 100 of the exercise apparatus comprises a first hand grip 116 and the second side 108 of the body of the first embodiment 100 comprises a second hand grip 118. In an example, the first hand grip 116 comprises a first shape and the second hand grip 118 comprises a second shape. As depicted, the first shape differs from the second shape. More specifically, the first shape of the first hand grip 116 comprises a portion 126 disposed between two parallel openings (e.g., a first opening 124A and a second opening 124B) spanning a length of the first side 106 from the first opening to the second opening. The two parallel openings (e.g., the first opening 124A and the second opening 124B) are perpendicular to the first opening and are perpendicular to the second opening.

As depicted, the second shape of the second hand grip 118 comprises a portion 132 disposed between two horizontal openings (e.g., a third opening 130A and a fourth opening 130B) spanning a width of the second side 108. In this example, the two horizontal openings (e.g., the third opening 130A and the fourth opening 130B) are parallel to the first opening and are parallel to the second opening. Furthermore, it should be appreciated that the first hand grip 116 is perpendicular to the second hand grip 118.

It should be appreciated that the user may grasp either the first hand grip 116 or the second hand grip 118 in numerous ways during a time period when engaging with the first embodiment 100 of the exercise apparatus. As an example, the user may grasp the portion 126 of the first hand grip 116 when engaging with the first embodiment 100 of the exercise apparatus. As a further example, the user may grasp the portion 132 of the second hand grip 118 when engaging with the first embodiment 100 of the exercise apparatus. Further, the user may grasp a portion of the second hand grip 118 disposed between the third opening 130A and the first opening of the body of the first embodiment 100 of the exercise apparatus. In another example, the user may grasp a portion of the second hand grip 118 disposed between the fourth opening 130B and the second opening of the body of the first embodiment 100 of the exercise apparatus. As an additional example, the user may place his/her arm through the hollow interior of the first embodiment 100 of the exercise apparatus and may grasp a portion of the second hand grip 118 disposed between the third opening 130A and the first opening of the body of the first embodiment 100 of the exercise apparatus or a portion of the second hand grip 118 disposed between the fourth opening 130B and the second opening of the body of the first embodiment 100 of the exercise apparatus. In this example, the first embodiment 100 of the exercise apparatus sits on a wrist of the user. Moreover, with such grasp, the user may perform a bicep curl exercise.

Since the first embodiment 100 of the exercise apparatus comprises multiple hand-grip locations, a user is able to engage in numerous exercises with the first embodiment 100 of the exercise apparatus. Such exercises may include: a bench press, a bicep curl, a shoulder press, a bent over row, a one arm swing, a Russian twist, a triceps extension, lunges, a calf raise, a triceps kickback, a lateral raise, a lying dumbbell fly, and/or a weighted sit-up/jack knives. It should be appreciated that such exercises are provided for illustrative purposes only and other exercises are contemplated by Applicant.

The third side 110 of the body of the exercise apparatus comprises a first receiving portion 128 configured to receive a first weight 138 therein. Moreover, the fourth side 112 of the body of the exercise apparatus comprises a second receiving portion 114 configured to receive a second weight 136 therein. When the first weight 138 is received by the first receiving portion 128, the first weight 138 is substantially flush with the third side 110. When the second weight 136 is received by the second receiving portion 114, the second weight 136 is substantially flush with the fourth side 112. It should be appreciated that each of the first weight 138 and the second weight 136 may be any weight denomination (e.g., 2 pounds, 5 pounds, 10 pounds, 15 pounds, etc.).

As depicted, the first weight 138 and the second weight 136 share a shape. In examples, the shape of each of the first weight 138 and the second weight 136 may be a rectangular shape or a substantially rectangular shape, among other examples not explicitly listed herein. As such, a shape of the first embodiment 100 of the exercise apparatus may be a cubic shape, a substantially cubic shape, a rectangular shape, or a substantially rectangular shape, among other examples not explicitly listed herein.

In examples, the first weight 138 is affixed to the first receiving portion 128 and the second weight 136 is affixed to the second receiving portion 114 via a fixation means 122. Illustrative examples of fixation means 122 include magnetic fixation means, a bolt and screw fixation means, a snap fixation means (e.g., at least one set of snap studs or snap sockets), or an adhesive fixation means, among other examples not explicitly listed herein. In an illustrative example, the first receiving portion 128 may comprise a magnetic portion or one or more magnets and the first weight 138 may comprise another magnetic portion or one or more other magnets such that a magnetic attraction between the magnetic portion or the one or more magnets of the first receiving portion 128 and the other magnetic portion or the one or more other magnets of the first weight 138 to affix the first weight 138 to the first receiving portion 128. However, it should be appreciated that any fixation means 122 may be used to affix the weight to the respective receiving portion.

Figure 13:
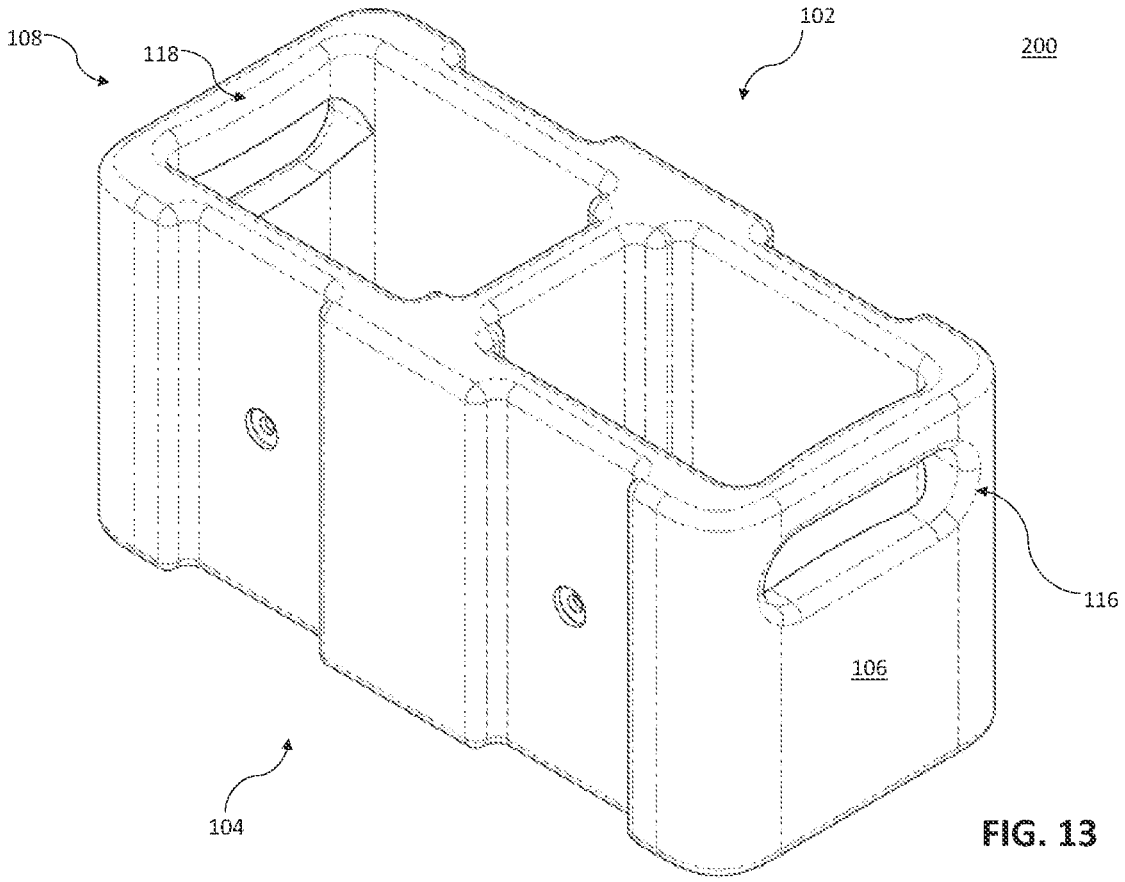
FIG. 13 and FIG. 14 depict perspective views of schematic diagrams of a second embodiment of an exercise apparatus, according to at least some embodiments disclosed herein.
Figure 14:
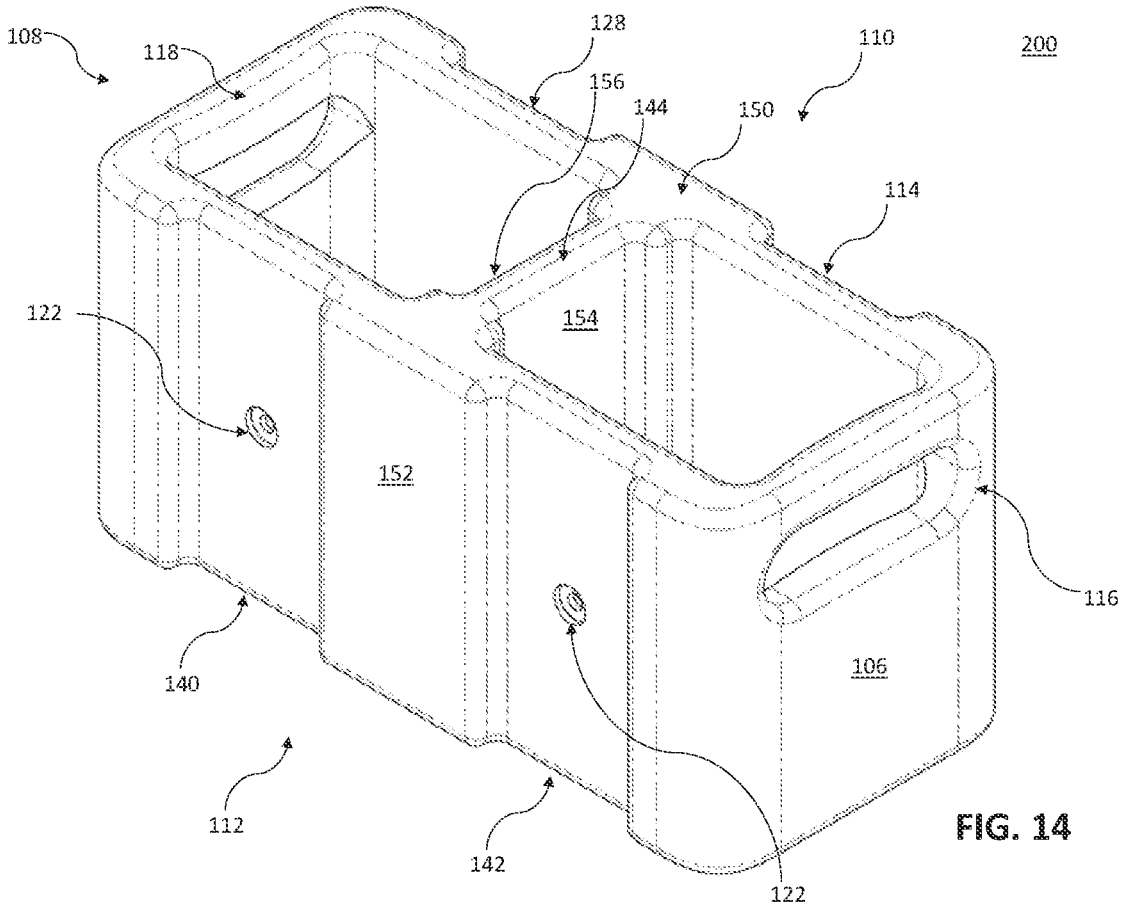
Figure 15:
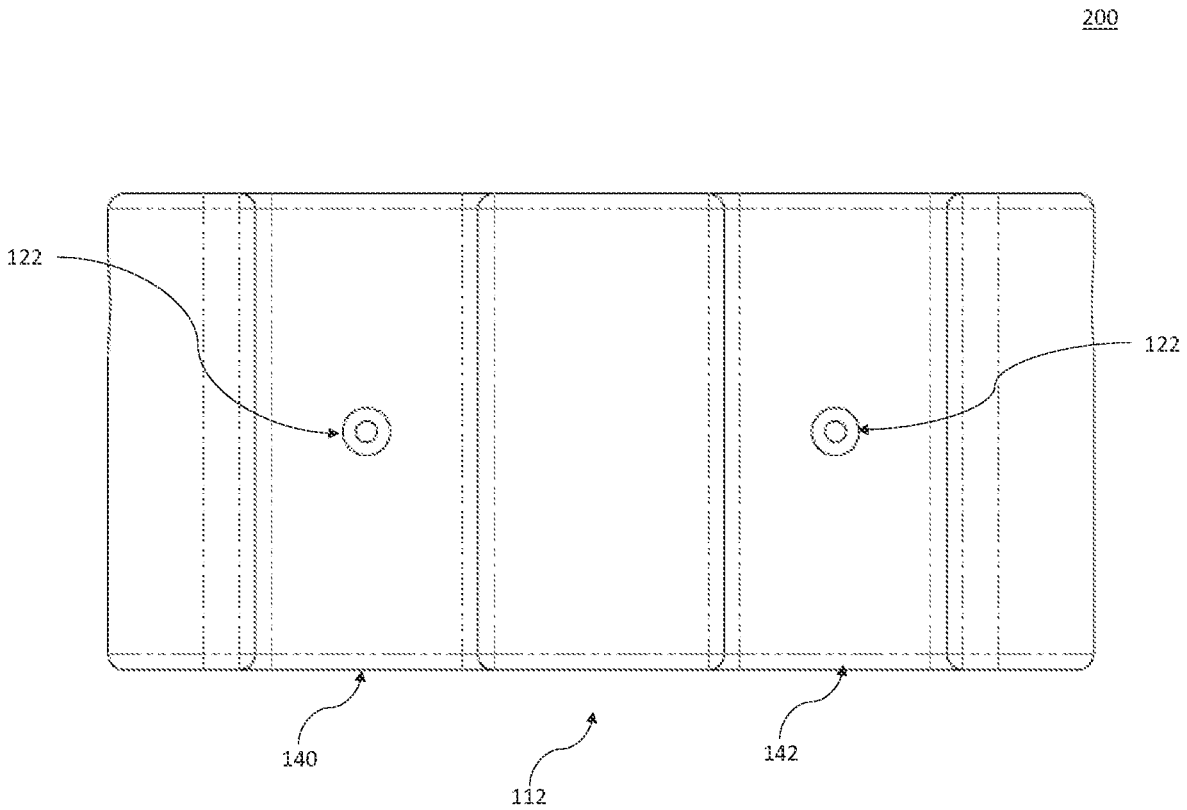
FIG. 15 depicts a side view of a schematic diagram of a second embodiment of an exercise apparatus, according to at least some embodiments disclosed herein.
Figure 16:
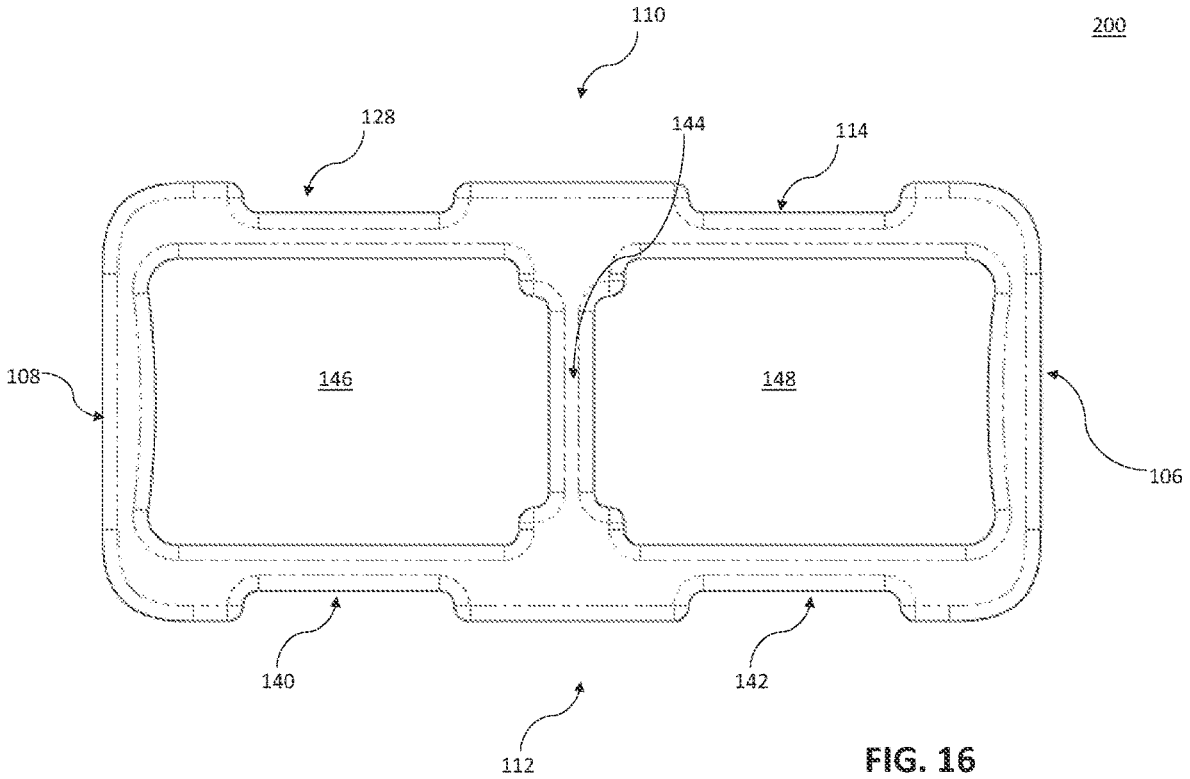
FIG. 16 depicts a top down view of a schematic diagram of a second embodiment of an exercise apparatus, according to at least some embodiments disclosed herein.
Figure 17:
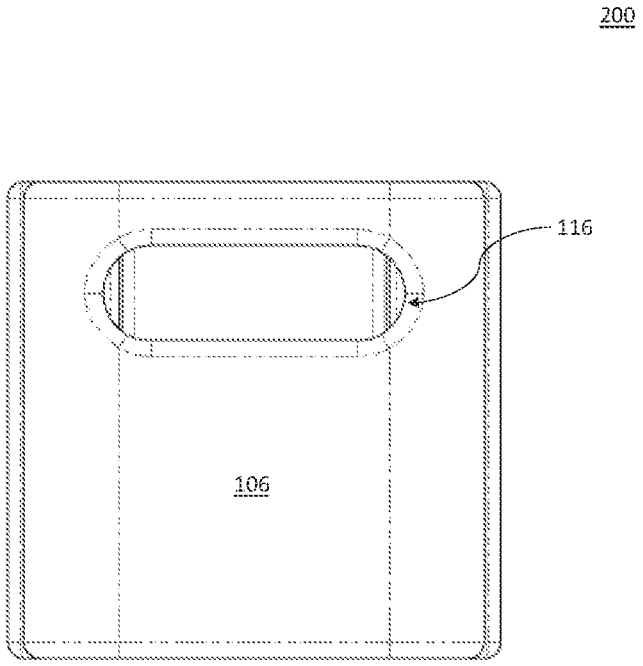
FIG. 17 depicts a side view of a schematic diagram of a second embodiment of an exercise apparatus, the second embodiment of an exercise apparatus comprising a first hand grip, according to at least some embodiments disclosed herein.
Figure 18:
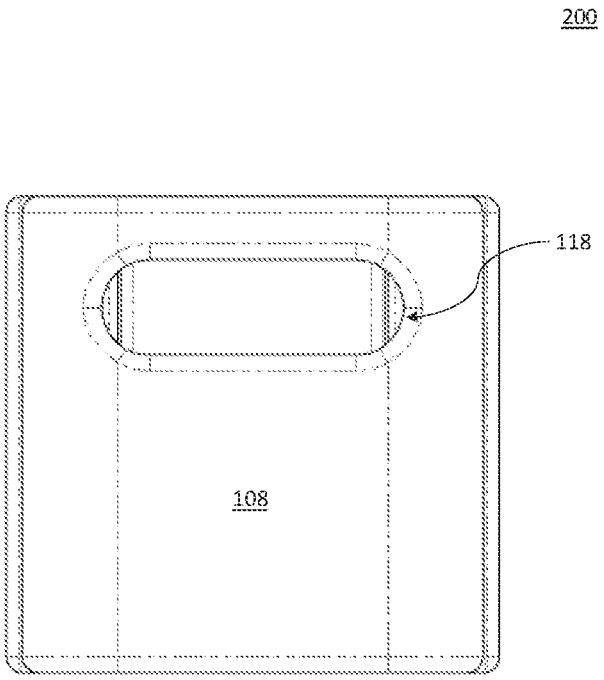
FIG. 18 depicts a side view of a schematic diagram of a second embodiment of an exercise apparatus, the second embodiment of an exercise apparatus comprising a second hand grip, according to at least some embodiments disclosed herein.
Figure 19:
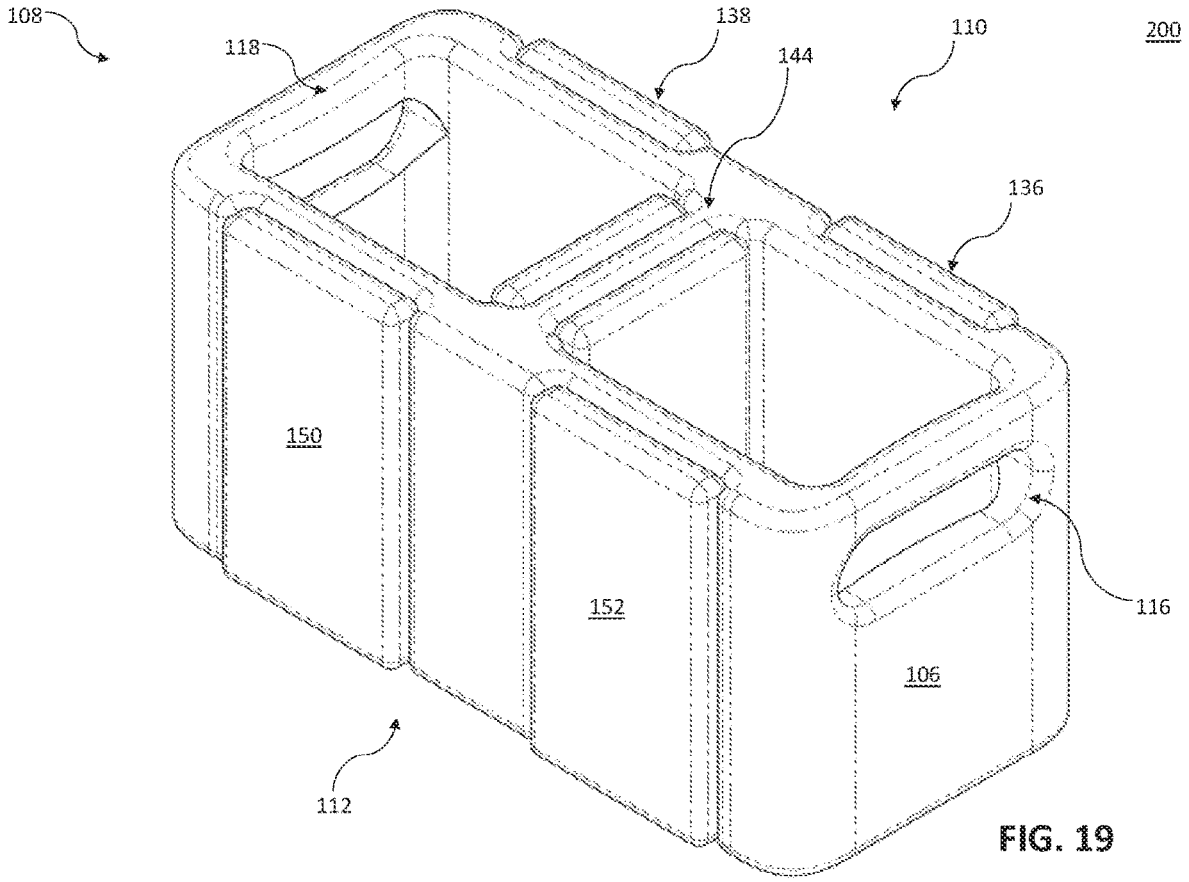
FIG. 19 depicts a perspective view of a schematic diagram of a second embodiment of an exercise apparatus, the exercise apparatus having one or more weights affixed to one or more receiving portions of the exercise apparatus, according to at least some embodiments disclosed herein.
Figure 20:
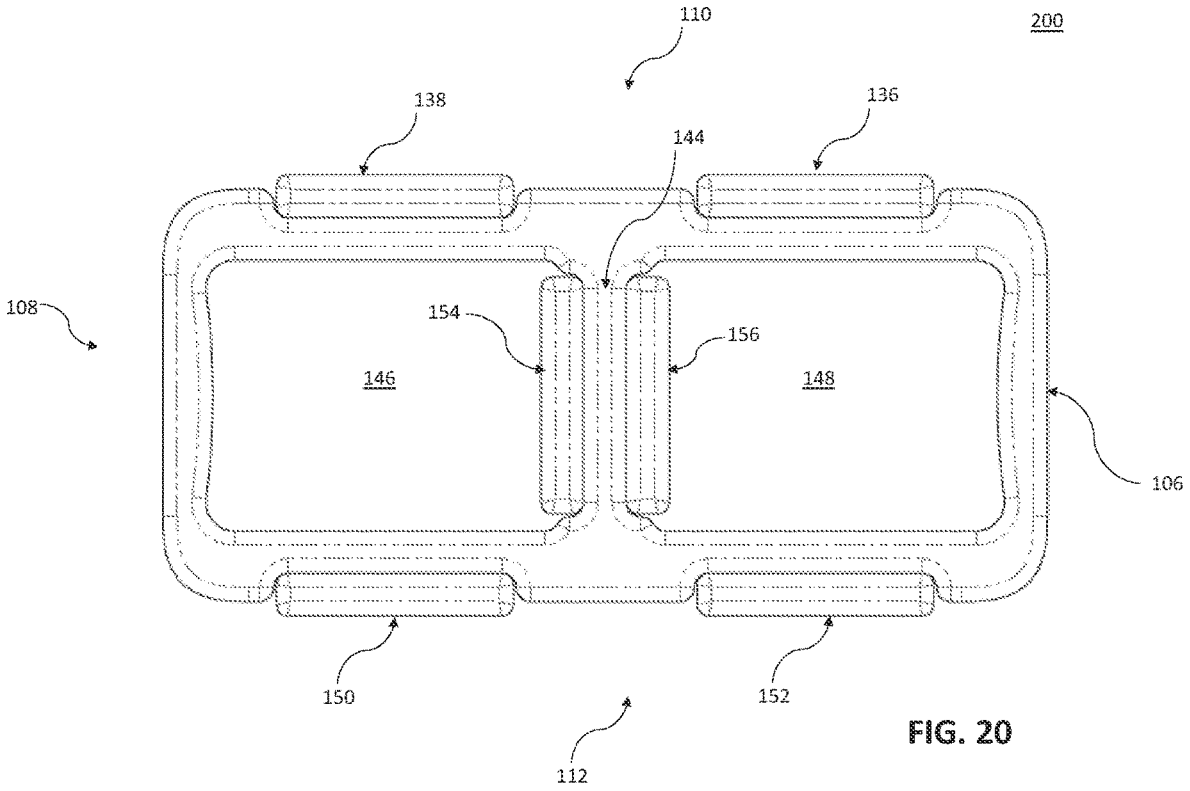
FIG. 20 depicts a top down view of a schematic diagram of a second embodiment of an exercise apparatus, the exercise apparatus having one or more weights affixed to one or more receiving portions of the exercise apparatus, according to at least some embodiments disclosed herein.
Figure 21:
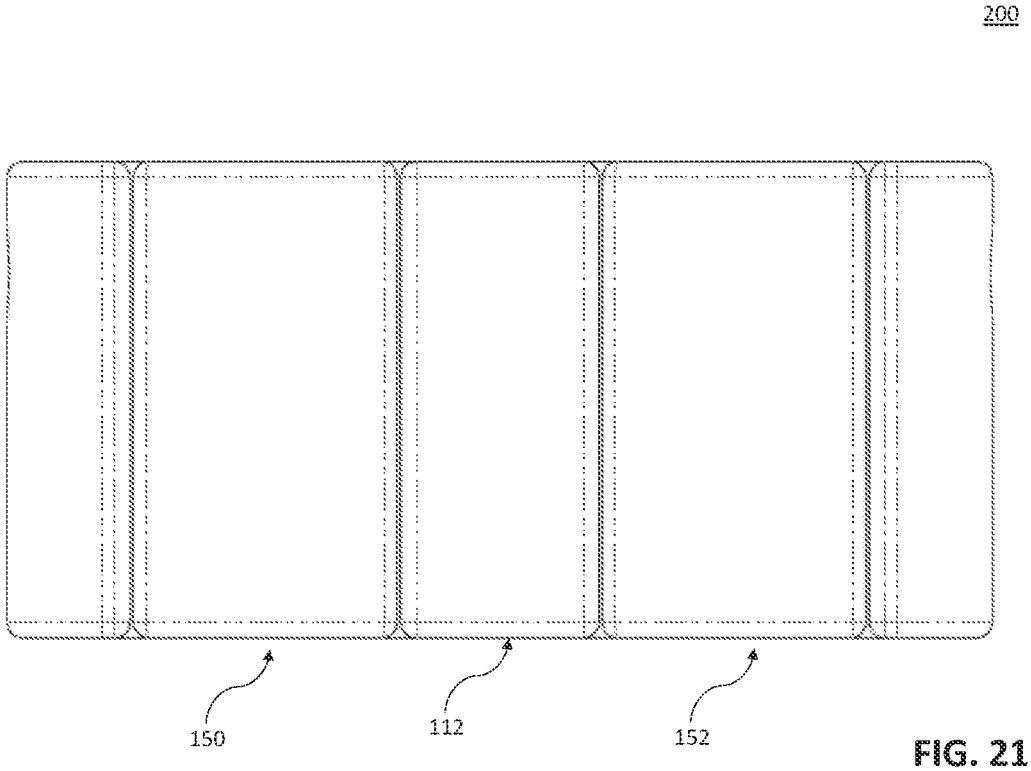
FIG. 21 depicts a side view of a schematic diagram of a second embodiment of an exercise apparatus, according to at least some embodiments disclosed herein.

A second embodiment 200 of the exercise apparatus is depicted in FIG. 13-FIG. 21. The second embodiment 200 of the exercise apparatus comprises a body. The body includes a first end 102 disposed opposite a second end 104. Moreover, the body of the second embodiment 200 of the exercise apparatus includes a first side 106 disposed opposite a second side 108 and a third side 110 disposed opposite a fourth side 112.

The first side 106 of the body of the second embodiment 200 of the exercise apparatus comprises a first hand grip 116. The second side 108 of the body of the of the second embodiment 200 of the exercise apparatus comprises a second hand grip 118. It should be appreciated that the user may grasp both the first hand grip 116 and the second hand grip 118 during a time period to perform an exercise and engage with the second embodiment 200 of the exercise apparatus. Similar to the first embodiment 100 of the exercise apparatus, the second embodiment 200 of the exercise apparatus comprises these multiple hand-grip locations, which allow the user to engage in numerous exercises with the second embodiment 200 of the exercise apparatus, as explained supra in relation to the first embodiment 100 of the exercise apparatus.

In examples, the first hand grip 116 and the second hand grip 118 share a shape. In this example, the shape of each of the first hand grip 116 and the second hand grip 118 comprises an opening proximate the first end of the body. The shape of the first hand grip 116 and the second hand grip 118 is substantially oblong. However, the shape of the first hand grip 116 and the second hand grip 118 is not limited to such. Moreover, the shape of each of the first hand grip 116 and the second hand grip 118 is parallel to the first end of the body.

In additional examples, the first side 106 and the second side 108 of the second embodiment 200 of the exercise apparatus share a first length. The third side 110 and the fourth side 112 of the second embodiment 200 of the exercise apparatus share a second length. The second length is greater than the first length such that the exercise apparatus is rectangular in shape.

The third side 110 of the body of the second embodiment 200 of the exercise apparatus includes a first portion 150 disposed between a first receiving portion 128 configured to receive a first weight 138 therein and a second receiving portion 114 configured to receive a second weight 136 therein. Moreover, the fourth side 112 of the body of the second embodiment 200 of the exercise apparatus comprises a second portion 152 disposed between a third receiving portion 140 configured to receive a third weight 150 therein and a fourth receiving portion 142 configured to receive a fourth weight 152 therein.

A third portion 144 is disposed perpendicular to the first portion and perpendicular to the second portion such that the third portion divides an interior of the body into a first hollow interior portion 146 and a second hollow interior portion 148. The third portion 144 of the body of the exercise apparatus comprises a fifth receiving portion 156 proximate the first hollow interior portion 146 and a sixth receiving portion 154 proximate the second hollow interior portion 148. The fifth receiving portion 156 is configured to receive a fifth weight 154 therein and the sixth receiving portion 154 is configured to receive a sixth weight 156 therein.

It should be appreciated that each of the first weight 138, the second weight 136, the third weight 150, the fourth weight 152, the fifth weight 154, and the sixth weight 156 are affixed to the first receiving portion 128, the second receiving portion 114, the third receiving portion 140, the fourth receiving portion 142, the fifth receiving portion 156, and the sixth receiving portion 154, respectively, via the fixation means 122, as explained supra.

It should further be appreciated the first weight 138, the second weight 136, the third weight 150, the fourth weight 152, the fifth weight 154, and the sixth weight 156 may be of differing weights and the weight of each of the first weight 138, the second weight 136, the third weight 150, the fourth weight 152, the fifth weight 154, and the sixth weight 156 is not limited to any particular weight denomination. Moreover, it should be appreciated that one or more of the weights may be affixed to one or more receiving portions during a time period. For example, during a first time period, the first weight 138 may be affixed to the first receiving portion 128 and the second weight 136 may be affixed to the second receiving portion 114 of the first embodiment 100 of the exercise apparatus. In another example, during a second time period, the first weight 138, the second weight 136, the third weight 150, and the fourth weight 152 may be affixed to the first receiving portion 128, the second receiving portion 114, the third receiving portion 140, the fourth receiving portion 142, respectively, for the second embodiment 200 of the exercise apparatus.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others or ordinary skill in the art to understand the embodiments disclosed herein.

When introducing elements of the present disclosure or the embodiments thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. An adjustable dumbbell comprising:
a body comprising:
a first end disposed opposite a second end;
a first side disposed opposite a second side,
wherein the first side comprises a first hand grip,
wherein the second side comprises a second hand grip, and
wherein the first hand grip is oriented perpendicular about a vertical axis to the second hand grip;
a third side disposed opposite a fourth side,
wherein the third side comprises a first receiving portion, and
wherein the fourth side comprises a second receiving portion; and
a hollow interior;
a first opening proximate the first end of the body;
a second opening proximate the second end of the body;
wherein the first hand grip spans a distance from the first end to the second end;
wherein the second hand grip spans a distance between the third side and the fourth side; and
at least one weight configured to be removably affixed to an outer surface of the third side, the fourth side, or a combination thereof.

2. The adjustable dumbbell of claim 1,
wherein the first hand grip comprises a first shape,
wherein the second hand grip comprises a second shape, and
wherein the first shape differs from the second shape.

3. The adjustable dumbbell of claim 2, wherein the first shape of the first hand grip comprises a portion disposed between two parallel openings spanning a length of the first side from the first opening to the second opening.

4. The adjustable dumbbell of claim 3,
wherein the two parallel openings are perpendicular to the first opening, and
wherein the two parallel openings are perpendicular to the second opening.

5. The adjustable dumbbell of claim 2, wherein the second shape of the second hand grip comprises a portion disposed between two horizontal openings spanning a width of the second side.

6. The adjustable dumbbell of claim 5,
wherein the two horizontal openings are parallel to the first opening, and
wherein the two horizontal openings are parallel to the second opening.

7. The adjustable dumbbell of claim 1, wherein the at least one weight comprises a first weight and a second weight, and wherein the first weight and the second weight share a shape.

8. The adjustable dumbbell of claim 7, wherein the shape of each of the first weight and the second weight is a rectangular shape.

9. The adjustable dumbbell of claim 1, wherein the at least one weight is affixed to the first receiving portion or the second receiving portion via a fixation means.

10. The adjustable dumbbell of claim 9, wherein the fixation means is selected from the group consisting of: a magnetic fixation means, a bolt and screw fixation means, a snap fixation means, and an adhesive fixation means.

11. The adjustable dumbbell of claim 1, wherein a shape of the adjustable dumbbell is selected from the group consisting of: a cubic shape and a rectangular shape.

* * * * *